US006169813B1

(12) United States Patent
Richardson et al.

(10) Patent No.: US 6,169,813 B1
(45) Date of Patent: Jan. 2, 2001

(54) FREQUENCY TRANSPOSITIONAL HEARING AID WITH SINGLE SIDEBAND MODULATION

(75) Inventors: Charles S. Richardson; Arnold S. Lippa, both of Tucson, AZ (US)

(73) Assignee: Hearing Innovations Incorporated, Tucson, AZ (US)

( * ) Notice: Under 35 U.S.C. 154(b), the term of this patent shall be extended for 0 days.

(21) Appl. No.: 08/212,571

(22) Filed: Mar. 16, 1994

(51) Int. Cl.[7] ..... H04R 25/00
(52) U.S. Cl. ..... 381/312; 381/316; 381/320
(58) Field of Search ..... 381/68.2, 68.4, 381/68, 68.3, 23.1, 312, 316, 320, 321, 315, 326; 607/56, 55, 57; 455/109; 600/25

(56) References Cited

U.S. PATENT DOCUMENTS 2,995,633 * 8/1961 Puharich et al. ..... 381/68.3
3,170,993 * 2/1965 Puharich et al. ..... 381/68.3
3,393,279 * 7/1968 Flanagan ..... 607/56
3,563,246 * 2/1971 Puharich et al. ..... 607/55
4,156,116 * 5/1979 Yanick ..... 381/68.2
4,419,544 * 12/1983 Adelman ..... 381/68.2
4,686,705 * 8/1987 Smith ..... 455/109
4,982,434 * 1/1991 Lenhardt et al. ..... 381/68.3

* cited by examiner

*Primary Examiner*—Huyen Le
(74) *Attorney, Agent, or Firm*—Rothwell, Figg, Ernst & Manbeck

(57) ABSTRACT

A hearing aid apparatus and method of the type in which audio frequency signals are frequency upshifted to ultrasonic frequency bands and are applied as vibrations to the human body to generate a hearing response. Frequency upshifting of the audio frequency signals to the ultrasonic frequency band is attained in one embodiment by amplitude modulation of an ultrasonic frequency carrier signal with an audio frequency modulating signal to form a modulated signal in which one of the two sidebands is either completely or substantially suppressed and a modulated signal having only one predominant sideband is thus derived for application to the human sensory system to generate a hearing response.

11 Claims, 3 Drawing Sheets

FREQUENCY TRANSPOSITIONAL HEARING AID WITH SINGLE SIDEBAND MODULATION

The present invention relates to hearing aids for the deaf and the hearing impaired and, in particular, to a hearing aid apparatus and method which utilize frequency transposition of signals from the audio frequency range to another frequency range, such as the ultrasonic frequency range, and vibratory transmission to the human sensory system of the frequency shifted signals as a means of communicating with the human sensory system.

BACKGROUND AND PRIOR ART

A hearing aid system of one general type to which the present invention relates is disclosed in U.S. Pat. No. 4,982,434—Lenhardt et al. In the referenced patent, there is disclosed a hearing aid system which utilizes such shifting of signals from the audio frequency range to the ultrasonic frequency range (referred to as "supersonic" frequency range in the referenced patent) and bone conduction of the ultrasonically shifted signals for communication with the human sensory system. In one embodiment of the invention as disclosed in the referenced patent, an audio frequency signal is amplitude modulated onto an ultrasonic carrier for bone conduction transmission. In that embodiment, amplitude modulation is carried out by utilizing the analog audio signal as the modulating signal to modulate an analog ultrasonic carrier signal. In such a modulation system as disclosed in the referenced patent, an amplitude modulated signal with double (upper and lower) sidebands is derived.

The referenced system has provided excellent results in permitting the severely hearing impaired and even otherwise totally deaf persons to sense and understand audio frequency communications which have been frequency upshifted to the ultrasonic frequency range. It is an object of the present invention to provide even further improvements in systems of the aforementioned type.

SUMMARY OF THE INVENTION

The present invention provides further improvements in systems of the aforementioned type by providing an apparatus and method in which amplitude modulation of an ultrasonic frequency carrier signal is attained with an audio frequency modulating signal and in which one of the two sidebands is either completely or substantially suppressed and a modulated signal having only one predominant sideband is derived for application to the human sensory system. As will be more fully explained below, it has been discovered that the physiology of the human sensory system is more responsive to a an amplitude modulated frequency upshifted signal having only a single predominant sideband than to a double sideband amplitude modulated signal. The apparatus and method of the present invention provide such a single sideband amplitude modulated ultrasonic signal in a hearing aid apparatus. In one embodiment of the present invention where the lower sideband was suppressed and only the upper sideband was utilized, significant improvements in hearing response performance were realized.

Other objects and advantages of the present invention will be apparent from the detailed description which follows, taken in connection with the accompanying drawings.

BRIEF DESCRIPTION OF THE DRAWINGS

FIG. 2(*a*) is a cross sectional view of a combination transducer/applicator utilizing a piezoelectric element for use in the present invention;

DETAILED DESCRIPTION OF THE INVENTION

In the present invention, a hearing response to audio frequency signals is generated using an ultrasonic frequency carrier signal which is amplitude modulated with the audio frequency signals with one sideband of the modulated signal being suppressed to form a predominantly single sideband amplitude modulated signal. The single sideband amplitude modulated signal is applied in vibratory form to a portion of the human body, such as a portion of the head of a subject, to generate a hearing response. As pointed out above, it has been discovered that an amplitude modulated ultrasonic frequency signal having only one predominant sideband is more effective in this type of hearing aid apparatus than a double sideband signal of the prior art.

Figure 1:
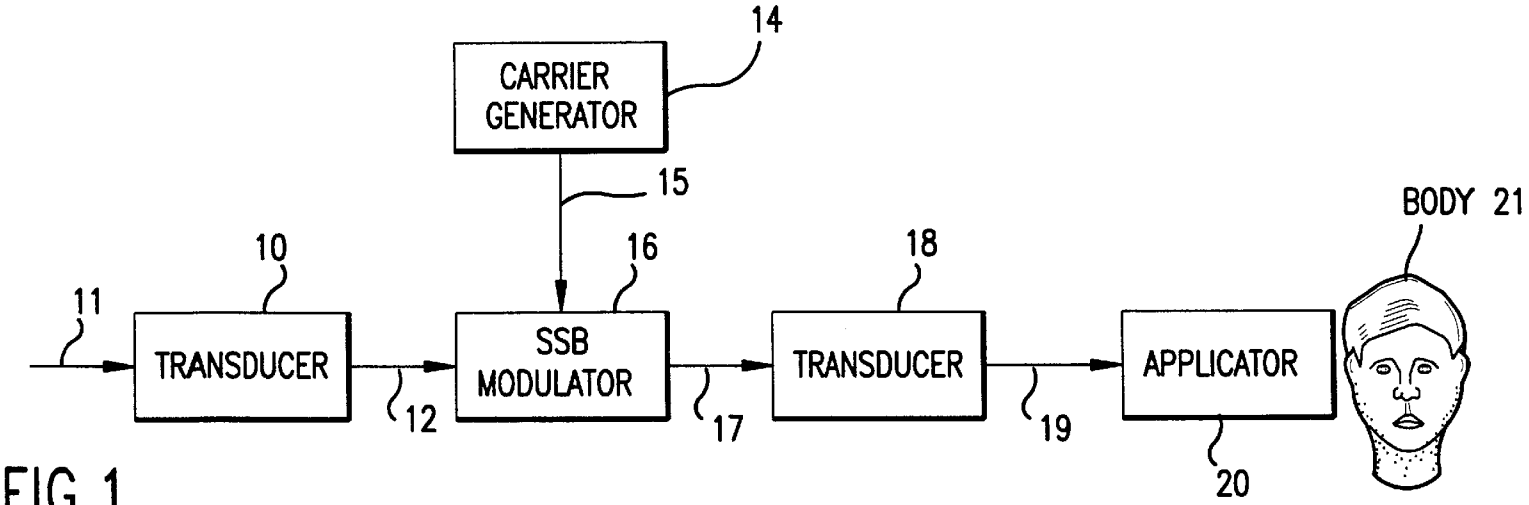
FIG. 1 is a block diagram of one embodiment of the system of the present invention.

Referring now to FIG. 1, there is shown a system block diagram of one embodiment of the present invention in which a predominantly single sideband modulated ultrasonic frequency signal of the aforementioned type is formed and applied to the human body to enable hearing perception. In this embodiment, a transducer 10 transposes an audio airborne signal 11, such as a voice signal, into an electrical signal 12. The audio signal 11 may also, of course, be any audio frequency signal such as information of any kind represented in the form of audio frequency signals intended to be communicated to a human subject. Typical audio frequencies are in the range of from about 100 Hz to about 10,000 Hz. Those audio frequencies that are critical for speech detection are typically in the range of from about 500 Hz to about 2,500 Hz.

For the purposes of the present invention, the electrical audio frequency signal 12 is upshifted in frequency by means of single sideband amplitude modulation of an ultrasonic frequency carrier signal; that is, an amplitude modulated signal in which one of the sidebands is entirely or substantially suppressed and in which only a single predominant sideband remains. In the embodiment of FIG. 1, a carrier generator 14 generates an ultrasonic frequency electrical carrier signal which is preferably in the form of a sinusoidal signal at 15. As used herein, the term "ultrasonic frequencies" means frequencies which are above the normal human hearing range which is generally accepted as having an upper cut-off frequency of about 20,000 Hz. In a preferred embodiment of the present invention, an ultrasonic carrier Frequency of about 30 kHz was found to provide good results.

A single sideband amplitude modulator 16 is provided for accepting the electrical audio frequency signal 12 and the ultrasonic carrier signal 15 and amplitude modulating the carrier signal 15 with the audio frequency signal 12 to form an ultrasonic single sideband amplitude modulated signal at 17.

The single sideband amplitude modulated signal 17 is formed with one sideband entirely or substantially suppressed or attenuated such that only a single predominant sideband remains. Suppression of one sideband can be accomplished in several different ways such as by filtering out or attenuating one of the sidebands, by using phase shift techniques or by using vestigial sideband modulation. Vestigial sideband modulation, which is included within the scope of single sideband modulation for purposes cf the present invention, is a form of modulation in which one sideband is substantially but not completely suppressed and in which one remaining sideband is predominant. Such single sideband suppression techniques are known to those skilled in the art and will be discussed below in further detail. All such single sideband techniques fall within the scope of the present invention as applied to the frequency shifted single sideband amplitude modulated ultrasonic frequency signal 17. Accordingly, as used herein, a "single sideband amplitude modulated signal" is one in which one of the sidebands is substantially suppressed such that only a single predominant sideband remains.

The ultrasonic single sideband amplitude modulated signal 17 is connected to a second transducer 18 which converts the input signal 17 to a vibratory signal at 19. The vibratory signal 19 is mechanically connected to an applicator 20 which applies the vibratory signal to a portion of the human body as represented at 21. The vibratory signal 19 may be of any physical form suitable for application to the human body to create a physical stimulus and may thus include physical ultrasonic wave pulsations transmitted a short distance through the air by the applicator 20 to physically impact the target portion of the body to which the vibratory signal is to be applied. For example, the applicator 20 may be in the form of a speaker which creates physical vibrations in the air, which vibrations are transmitted in wave form through the air to impact a selected portion of the body which has been determined to be responsive to physically applied vibrations. In such a case, the vibrations are directly physically applied to the selected portion of the human body by means of the interaction with and the resultant vibratory impact on the selected human body portion of the ultrasonic vibrations transmitted as waves through the air as a medium. The terms "applicator" and "applicator means" as used herein include all such apparatus.

The transducer 18 and the applicator 20 may be integrated into a single unit wherein the vibratory portion of the transducer 18 functions also as the applicator 20. Such an integrated unit is shown in cross sectional form in FIG. 2(*a*) in which a piezoelectric element 70 is positioned between electrodes 72 and 74, which are connected to the frequency upshifted modulated signal 17. The piezoelectric element 70 expands and contracts in response to the varying electric field applied through the electrodes to produce a vibratory signal in response to the input signal 17. An output pad 76, which is preferably formed of a firm but somewhat resilient insulating material such as a plastic material, is attached to electrode 74 for applying the vibrations thus produced directly to the human body portion 21.

Figure 2:
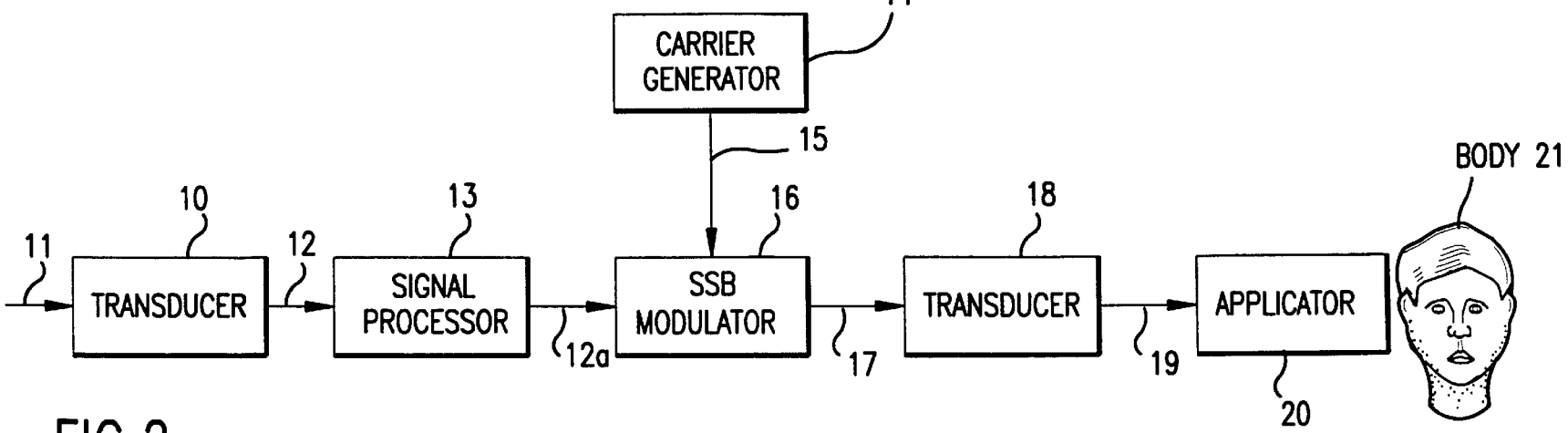
FIG. 2 is a block diagram of another embodiment of the present invention which includes a signal processor in which the audio frequency signal is processed in various ways as it is upshifted in frequency to an ultrasonic frequency.

The circuitry of a single sideband modulation system suitable for functioning as the modulator 16 is shown in block diagram form in FIG. 2. Before describing the circuitry of FIG. 2, a description of one methodology for the modulation of the audio frequency signal 12 onto the carrier signal 15 will be presented. In this first described methodology, substantially complete suppression of one sideband is attained. In other methodologies, as further described below, substantial suppression of one sideband is attained although some vestiges of the suppressed sideband may still remain.

Single sideband amplitude modulation in accordance with the present invention may be carried out, for example, using the circuitry shown in FIG. 2 in which one sideband is fully suppressed. In this embodiment, the audio frequency signal 12 may be represented as a function of time as x(t) and the carrier signal as $\omega_c$. To form directly an upper sideband modulated signal Xc(t) in which the carrier $\omega_c$ is modulated by x(t), the following mathematical relationship applies:

$$Xc(t)=x(t)\cos\omega_c t-\hat{x}(t)\sin\omega_c t \quad (1)$$

Where:

t is time

Xc(t) is the modulated frequency upshifted signal x(t) is the audio signal 12

$\hat{x}(t)$ is x(t) shifted by 90°

$\omega_c$ is the carrier or upshift frequency in radians

It will be observed from equation (1) that the elements of the equation must be computed and the operations performed in accordance with the equation to yield the single sideband modulated upshifted signal Xc(t). As set forth in equation (1), Xc(t) is an upper sideband modulated signal. A lower sideband signal may instead be formed by using the appropriate mathematical relationship of the elements. Thus, in accordance with the present invention, the signal Xc(t) may be single sideband modulated utilizing either the upper or the lower sideband. In the embodiment presented herein, the signal Xc(t) is modulated with the upper sideband.

In the embodiment of FIG. 2, the electrical audio signal 12 is split at 22 and is directed both to a phase shifter 24 and a multiplier 26. The phase shifter 24, which may be an element of a Hilbert transform phase shifter, produces a minus 90° phase shift in signal 12 to output a signal 28, which is $\hat{x}(t)$. The carrier generator 14 generates an ultrasonic frequency carrier signal 15 which is connected to cosine function generating element 30, which forms $\cos\omega_c t$ at 32.

The $\cos\omega_c t$ signal 32 is connected to multiplier 26 where it is multiplied by x(t) signal 12 to form $x(t)\cos\omega_c t$ at 34. The $\cos\omega_c t$ signal 32 is also connected to another phase shifter element 36, which may be another element of a Hilbert transform phase shifter along with element 24, to produce a minus 90° phase shifted signal at 38, which is $\sin\omega_c t$. Signals 28 and 38 are multiplied by each other by a multiplier to form signal 40, which is $\hat{x}(t)\sin\omega_c t$.

Signals 34 and 40 are subtracted from each other at subtractor 42 to form a single sideband (upper sideband, in the example given), amplitude modulated ultrasonic frequency signal 44 which is $x(t)\cos\omega_c t-\hat{x}(t)\sin\omega_c t$. The single sideband, amplitude modulated ultrasonic frequency signal 44 is connected to transducer 36 and converted to a vibratory signal as in the embodiment of FIG. 1 for application to a selected portion of the human body for transmission within the body.

Figure 3:
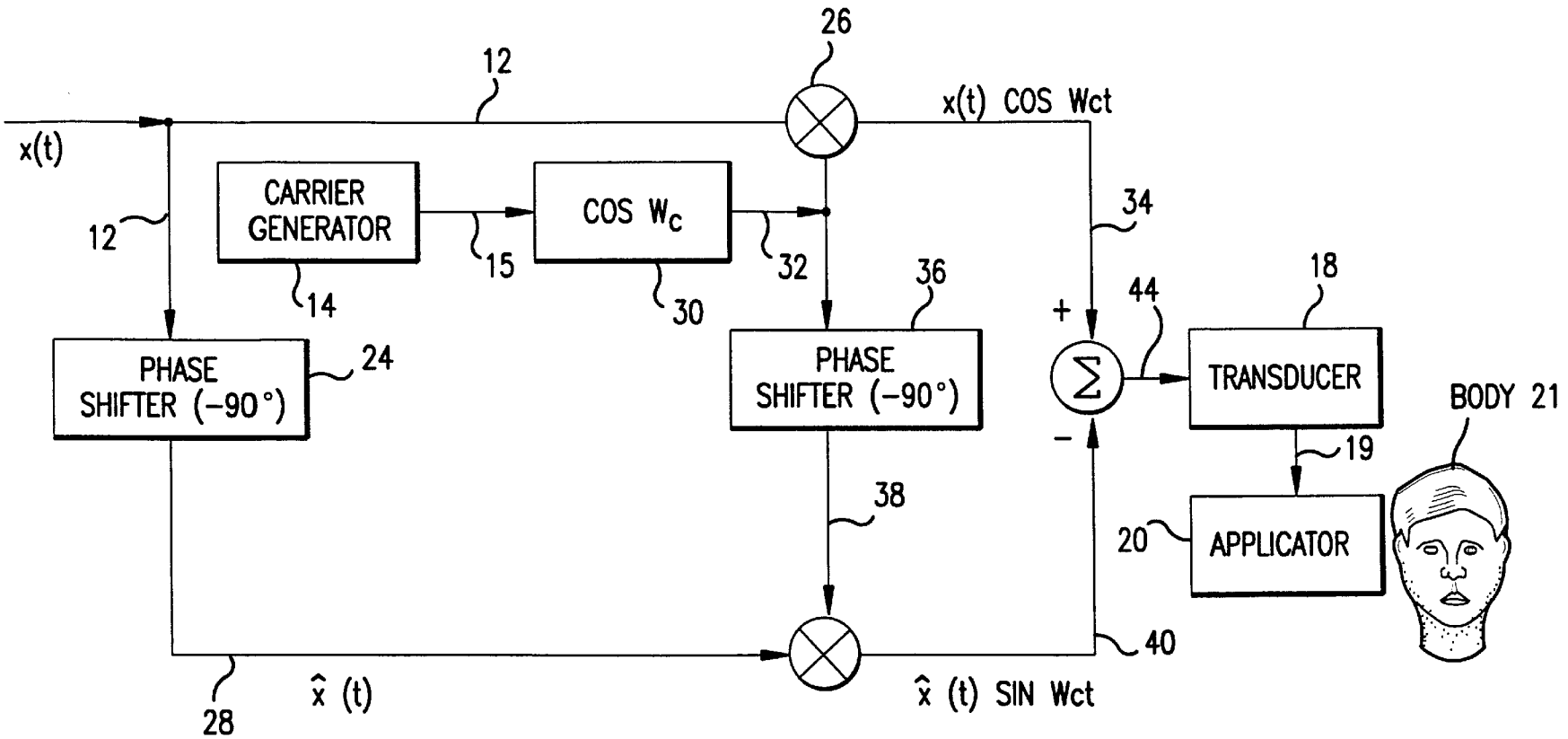
FIG. 3 is a block diagram of a single sideband amplitude modulating circuit suitable for operation in the embodiments of FIG. 1 and FIG. 2.

In another embodiment of the present invention, as shown in FIG. 3, the electrical audio signal 12 is processed through a signal processor 13 before it is modulated by the modulator 16. The signal. processor 13 functions to improve the quality of the audio signal 12, such as by filtering out noise components and other disturbances and performing other signal processing functions. The modulator 16 modulates the processed signal 12*a* onto the ultrasonic frequency carrier signal 15 and outputs a signal 17*a* which is the ultrasonic carrier signal 15 modulated with the processed signal 12*a*. The remainder of the circuit of FIG. 3 is the same as and operates in the same manner as the embodiment shown in FIG. 1.

The signal processor 13 also functions in selected applications to expand the bandwidth of the audio frequency information signal as it is shifted to a higher frequency range in order to provide a wider difference in the frequency bandwidth of the audio information signal relative to the shifted frequency for purposes of facilitating detection of "just noticeable differences" between the adjacent frequencies in the information signal. It is believed that such expansion in frequency bandwidth of the audio frequency information signal facilitates better detection of the frequency differences in the information signal at the shifted higher frequencies for some users of the hearing aid equipment. The amount of the bandwidth expansion can be selected to optimize the response in individual cases.

In the embodiment of FIG. 3, the signal processing and/or bandwidth expansion of the audio frequency information signal 12 is preferably effected before the frequency shift of the information signal to the higher frequency range. Where the frequency shift is effected by amplitude modulation of a higher frequency carrier signal, the bandwidth of the audio frequency information signal is expanded prior to the modulation of the carrier.

The expansion of the bandwidth of the audio frequency signal information signal may be effected by techniques known in the art. Examples of such techniques are shown in U.S. Pat. No. 4,419,544—Adelman and U.S. Pat. No. 4,051,331—Strong. As disclosed in the referenced Adelman patent, harmonic transposition of frequencies from one frequency band to another is accomplished by selective multiplication cr division of all component frequencies by a constant value. Such bandwidth expansion may also be accomplished by means of "Fast Fourier Transforms" to derive numerically the Fourier transforms of the component frequencies of the audio frequency signal for enabling frequency translations to be performed in a well known manner such as described in the aforementioned Adelman and Strong patents.

Such Fast Fourier Transform techniques are described, for example, in the book "Introduction to Communication Systems" Second Edition, by Ferrel G. Stremler, published in 1982 by Addison-Wesley Publishing Company, dealing with Fast Fourier Transform (FFT) techniques. As noted on pages 136–141 of the aforementioned book, the commonly used Cooley-Tukey FFT algorithm computes N discrete frequency components from N discrete time samples of a signal, where N is any selected number which is an integer power of 2. The specifics of the FFT techniques using this algorithm are described in detail in the referenced portion of the text, the subject matter of which is incorporated herein by reference.

Figure 4:
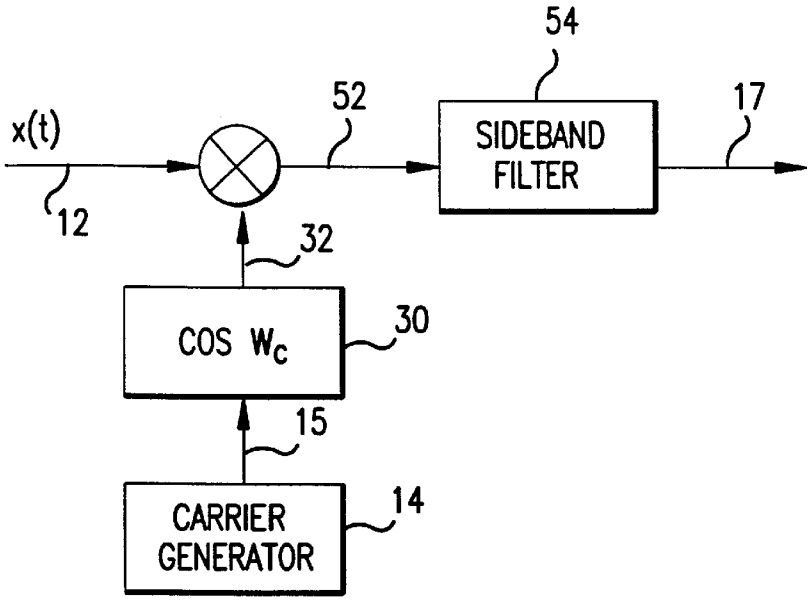
FIG. 4 is a block diagram of another embodiment of the present invention in which one of the sidebands is suppressed by means of a sideband filter.

In another embodiment of the present invention as shown in FIG. 4, single sideband modulation is accomplished by filtering out one of the sidebands. In this embodiment, the ultrasonic carrier frequency signal generator generates carrier signal 15 as in the embodiment of FIG. 3 and cosine generator 30 generates cos $\omega_c$ signal 32. The audio frequency signal 12, represented as a function of time x(t) and. the cos $\omega_c$ signal 32 are connected to a multiplier 50, which multiplies the two signals to form the double sideband modulated signal x(t)cos $\omega_c$ at 52.

A sideband filter 54 filters out a selected upper or lower sideband to form a substantially single sideband modulated signal 17, which is the signal 17 in the embodiment of FIG. 1. In the case where the upper sideband is the predominant sideband, the filter 54 is a high pass filter which cuts off in the vicinity of the frequency band of the lower sideband. In the case where the lower sideband is the predominant sideband, the filter 54 is a low pass filter which cuts off the frequency band of the upper sideband. A band pass filter may also be used as the filter 54 to filter out a selected one of the sidebands.

Ideally, the filter 54 should have a sharp cutoff in the vicinity of the carrier frequency to reject all frequency components on one side of the carrier frequency. However, since it is impossible to achieve an ideal filter characteristic, some compromise must be made in the realization of the actual filter characteristics and filters with some finite slope approaching the carrier frequency must be used. The audio bandwidth can be selected, particularly with respect to the lower frequencies which are to be utilized, such that the low frequency components complement the filter design. Vestigial sideband modulation, in which one of the sidebands is substantially attenuated relative to the other sideband by the filter 54, may also be used in the present invention. The advantages of the present invention may thus be attained where a substantial portion of one of the sidebands is attenuated or suppressed and all of the foregoing thus fall within the scope of the term "single sideband amplitude modulated signal" as that term is defined above.

Figure 5:
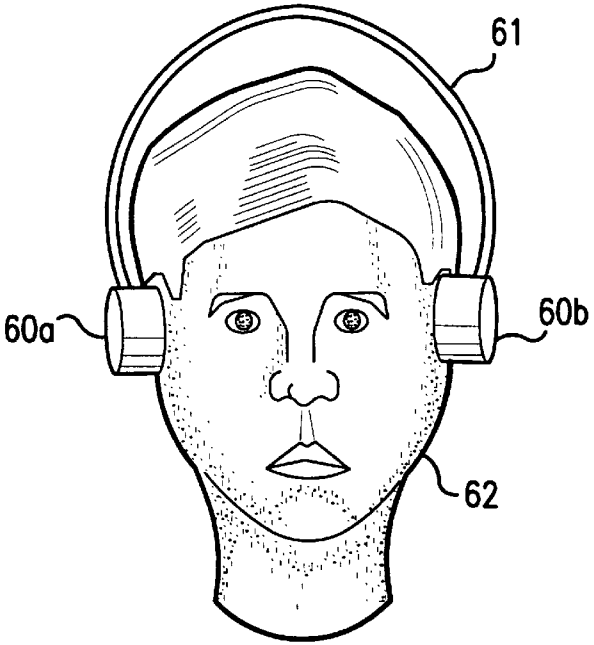
FIG. 5 is an illustration of a dual element hearing aid assembly which includes means for sensing and applying frequency upshifted signals to both sides of the head of a user.
Figure 2A:
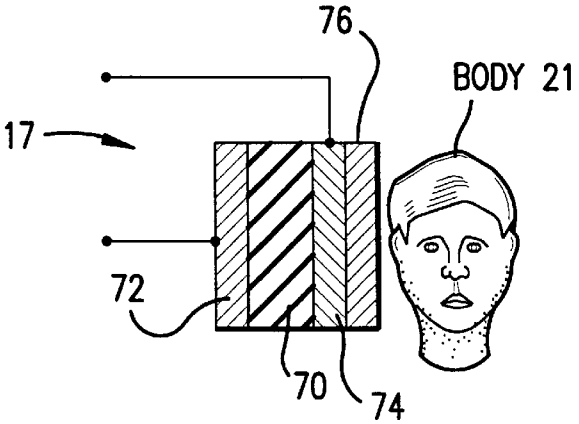

Referring now to FIG. 5, there is shown a configuration utilizing the improved hearing aid apparatus of the present invention in which hearing aid assemblies 60*a* and 60*b* are positioned on both sides of the head 62 of a user. The assemblies 60*a* and 60*b* are supported in place in contact with opposite sides of the head of the user by a resilient holder 61, which resiliently urges the assemblies 60*a* and 60*b* against the sides of the head of the user, preferably in contact with bone portions of the skull.

In a preferred embodiment of FIG. 5, both of the assemblies 60*a* and 60*b* are each a complete assembly of the elements 10, 14, 16, 18 and 20 of FIG. 1 or of elements 10, 13, 14, 16, 18 and 20 of FIG. 2. The audio frequency sounds that are detected and frequency upshifted by the assemblies 60*a* and 60*b* are therefore those which impinge at opposite sides of the head 62 of the user. Because the sounds thus detected and frequency upshifted for hearing response are positionally displaced from each other on the opposite sides of the head of the user, the configuration of FIG. 5 is useful for improved hearing perception and for special purposes such as, for example, echo detection.

In another embodiment of the configuration of FIG. 5, only the assembly 60*a* contains the full complement of the elements of FIG. 1 or FIG. 2. The other assembly 60*b* contains only the elements 18 and 20 and the frequency upshifted signal 17 is carried by an electrical conductor in the holder 61 from the assembly 60*a* to the assembly 60*b*. In this arrangement, the audio signal is detected only on the side of the head on which the assembly 60*a* is positioned and the same frequency upshifted signal 17 is then applied to the transducer 18 and applicator 20 positioned in each of the assemblies 60*a* and 60*b*. In this embodiment, therefore, the same frequency upshifted signal 17 is applied through combinations of transducers 18 and applicators 20 positioned on opposite sides of the head.

The embodiment of FIG. 5 may take other forms in which the frequency upshifted signal 17 is applied to multiple transducers 18 and applicators 20 positioned at various other points on the body of the user.

It is to be understood that the embodiments set forth herein are described in detail for purposes of providing a full and complete disclosure of the best mode of the present invention and of practicing the same, and that such detailed disclosure is therefore not to be interpreted as in any way limiting the scope of the present invention as defined in the appended claims. Various modifications and substitutions falling within the scope of the teachings set forth herein and within the scope of the appended claims will therefore occur to those skilled in the art.

What is claimed is:

1. A hearing aid apparatus for receiving and transmitting to the human sensory system an audio frequency signal for enabling human sensing of information contained in said audio frequency signal comprising:

first transducer means for converting an audio frequency sound signal into an audio frequency electrical signal;

generating means for generating an ultrasonic frequency electrical carrier signal;

single sideband amplitude modulating means for amplitude modulating said audio frequency electrical signal onto said ultrasonic frequency electrical carrier signal to form a single sideband amplitude modulated electrical signal;

second transducer means for converting said single sideband, amplitude modulated electrical signal into a vibratory signal; and applicator means for applying said vibratory signal to the human sensory system through physical interaction with the human body.

2. A hearing aid apparatus as set forth in claim 1 in which said single sideband amplitude modulating means comprises a phase shifter for forming a quadrature phase shifted signal from said audio frequency signal and providing said quadrature phase shifted signal and said audio frequency signal to said amplitude modulating means to form said single sideband amplitude modulated electrical signal.

3. A hearing aid apparatus as set forth in claim 1 wherein said single sideband amplitude modulating means includes means for substantially suppressing one of the sidebands relative to the other.

4. A hearing aid apparatus as set forth in claim 1 wherein said applicator means includes means for applying said vibratory signals to a portion of the head of a user.

5. A hearing aid apparatus as set forth in claim 4 wherein said second transducer means and said applicator means are configured for generating and applying said vibratory signal to a portion of one side of the head; and including third transducer means for converting said single sideband, amplitude modulated electrical signal into a second vibratory signal and second applicator means for generating applying said second vibratory signal to a portion of the other side of the head.

6. A hearing aid apparatus as set forth in claim 4 wherein said applicator means includes means for applying said vibratory signal to a portion of the head of a user for bone conduction within the head.

7. A hearing aid apparatus as set forth in claim 1 further comprising a signal processor for modification of said audio frequency electrical signal to improve the clarity of perceived hearing of the user.

8. A hearing aid apparatus as set forth in claim 7 wherein said signal processor includes means for expanding the bandwidth of said audio frequency electrical signal at said ultrasonic frequency carrier signal frequency.

9. A hearing aid apparatus as set forth in claim 1 wherein said second transducer means comprises a piezoelectric transducer for converting said single sideband, amplitude modulated electrical signal into a vibratory signal.

10. A method of generating a hearing response in the human body comprising:

converting an audio frequency sound signal, as to which a hearing response is to be generated, into an audio frequency electrical signal;

generating an ultrasonic frequency electrical carrier signal;

amplitude modulating said audio frequency electrical signal onto said ultrasonic frequency electrical carrier signal to thereby form a single sideband amplitude modulated electrical signal;

converting said single sideband, amplitude modulated electrical signal into a vibratory signal; and applying said vibratory signal to the human sensory system through physical contact with the human body to thereby generate a hearing response to said audio frequency sound signal.

11. The method of claim 10 including forming a quadrature phase shifted signal from said audio frequency signal and utilizing said quadrature phase shifted signal and said audio frequency signal in amplitude modulating said ultrasonic frequency electrical carrier signal to form said single sideband amplitude modulated electrical signal.

* * * * *